United States Patent [19]

Scotson et al.

[11] Patent Number: 5,062,404

[45] Date of Patent: Nov. 5, 1991

[54] ENGINE THROTTLE CONTROL SYSTEM

[75] Inventors: Peter G. Scotson, West Midlands; John M. Ironside, Birmingham, both of England

[73] Assignee: Lucas Industries Public Limited Company, England

[21] Appl. No.: 509,391

[22] Filed: Apr. 13, 1990

[30] Foreign Application Priority Data

Apr. 17, 1989 [GB] United Kingdom ..... 8908661

[51] Int. Cl.[5] ..... F02D 41/00; F02D 9/02

[52] U.S. Cl. ..... 123/399

[58] Field of Search ..... 123/361, 399

[56] References Cited

U.S. PATENT DOCUMENTS

| | | | |
|---|---|---|---|
| 4,519,361 | 5/1985 | Murakami | 123/361 |
| 4,569,320 | 2/1986 | Collonia | 123/399 |
| 4,612,615 | 9/1986 | Murakami | 123/361 |
| 4,735,181 | 4/1988 | Kaneko et al. | 123/361 |
| 4,941,444 | 7/1990 | Fujita | 123/361 |

*Primary Examiner*—Tony M. Argenbright
*Assistant Examiner*—Robert E. Mates
*Attorney, Agent, or Firm*—Jenner & Block

[57] ABSTRACT

An engine throttle control system actuates a throttle by means of a motor. In order to overcome static friction, a differentiator differentiates a throttle position demand signal and adds the differentiated signal to the demand signal. This composite signal is used by a control unit to drive the motor.

10 Claims, 2 Drawing Sheets

ENGINE THROTTLE CONTROL SYSTEM

Figure 1:
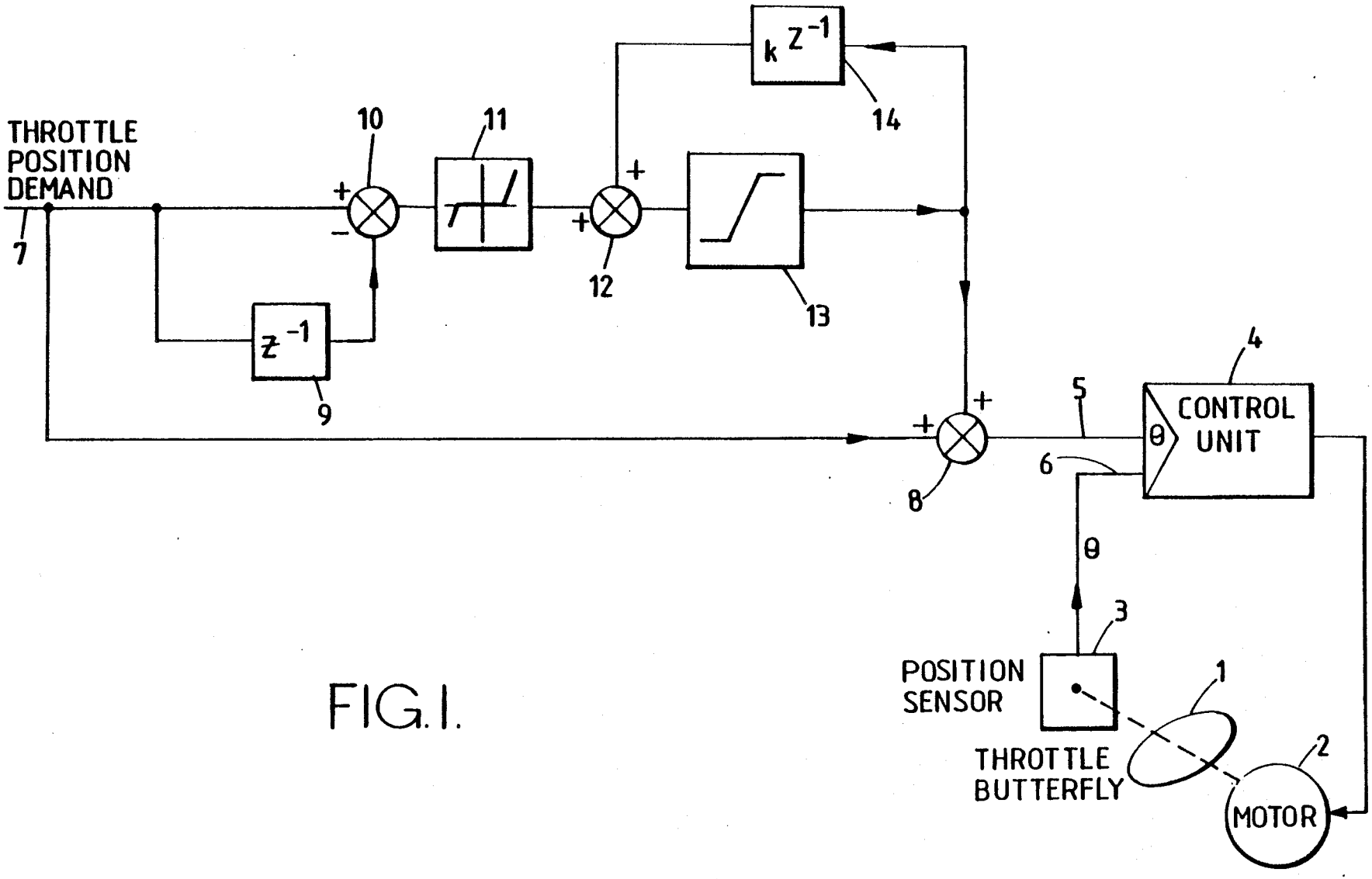

The present invention relates to an engine throttle control system, for instance for use in controlling an internal combustion engine for driving a vehicle.

Throttle control systems for controlling petrol and diesel engines for vehicles include the so-called "drive by wire" system in which there is no mechanical linkage between a driver actuated accelerator pedal or cruise control command switch and a mixture controlling system, such as one or more carburettors or a fuel injection system. Systems of this type also lend themselves readily to automatic traction control functions for preventing wheel spin during heavy acceleration and/or in conditions of poor ground adhesion. However, special requirements are placed on the performance of such systems, which must function reliably and in accordance with various design parameters at all times.

In such systems, the or each throttle butterfly is directly connected to a torque motor, which has relatively low inertia as seen from the throttle butterfly. The ratio of stiction (static friction) forces to inertia forces is therefore relatively high and the control system has to overcome the difficulty of maintaining precise control while responding quickly to small changes in demand. For instance, a relatively large change in the power supplied to the actuator may be necessary to start the throttle moving and particularly if the direction of movement is required to change. However, once moving, the response will be relatively rapid. The controller must therefore provide a rapid change in power with no change in throttle position to start movement or change direction of movement, followed by an equally rapid recovery once movement has begun or the direction of movement has changed.

According to the invention, there is provided an engine throttle control system for an engine throttle motor, comprising a control circuit for supplying a drive to the throttle motor in response to a throttle position demand signal, the control circuit including means for temporarily augmenting the drive to the throttle motor in response to a change in the throttle position demand signal.

Preferred embodiments of the invention are defined in the other appended claims.

In one embodiment of the invention, the control circuit comprises a differentiator for differentiating a demand signal and a summer for summing the differentiated signal and the demand signal.

It is thus possible to provide a system in which small changes in a demand signal are emphasised so as to cause the motor to move promptly. In order to reduce susceptibility to small noise signals, a deadband element may be arranged before or after the differentiator.

Preferably a limiter is provided between the differentiator and the summer. Limit values of the limiter can be chosen so that larger changes in demand do not cause excessive overshoot and thus demands can be limited to within the working range of the throttle.

The differentiator may comprise a delay element for delaying the demand signal, a subtraction element for subtracting the delayed demand signal from the demand signal, a summing element having a first input connected to the output of the subtraction element and an output connected to an input of a limiter, and a feedback path arranged to feed back a delayed portion of the output signal of the limiter to a second input of the summing element.

It is thus possible to provide a system which overcomes or reduces the effects of static friction in low inertia direct drive throttle motors. Motor response to changes in demand signal can be improved without substantially jeopardising accuracy of control once the motor has started moving.

In another embodiment of the invention, the control circuit is arranged to supply an initially alternating drive signal for the motor in response to a change in the demand signal.

Preferably the system further comprises a throttle position sensor and the control circuit is arranged to produce an error signal based on the difference between the demand signal and the output signal of the sensor for driving the motor in a direction for reducing the error signal, the amplitude of the initially alternating part of the drive signal being proportional to the error signal and being added to the error signal to form the motor drive signal. Preferably the amplitude is reduced in proportion to the rate of movement of the throttle.

Preferably the amplitude is limited to a predetermined maximum value and, when the amplitude is less than a predetermined minimum value, is made zero.

The alternating part may comprise several cycles, but preferably comprises a single cycle, after which the need for further cycles may be reassessed. Preferably the first half cycle has a polarity such as to drive the motor so as to tend to reduce the error signal.

Preferably the second half cycle has an amplitude smaller than that of the first half cycle.

It is thus possible to provide a system which provides a short torque "dither" when the throttle is almost stationary and in the wrong position so as to help overcome the static friction of the motor and throttle, thus improving throttle response.

Figure 2:
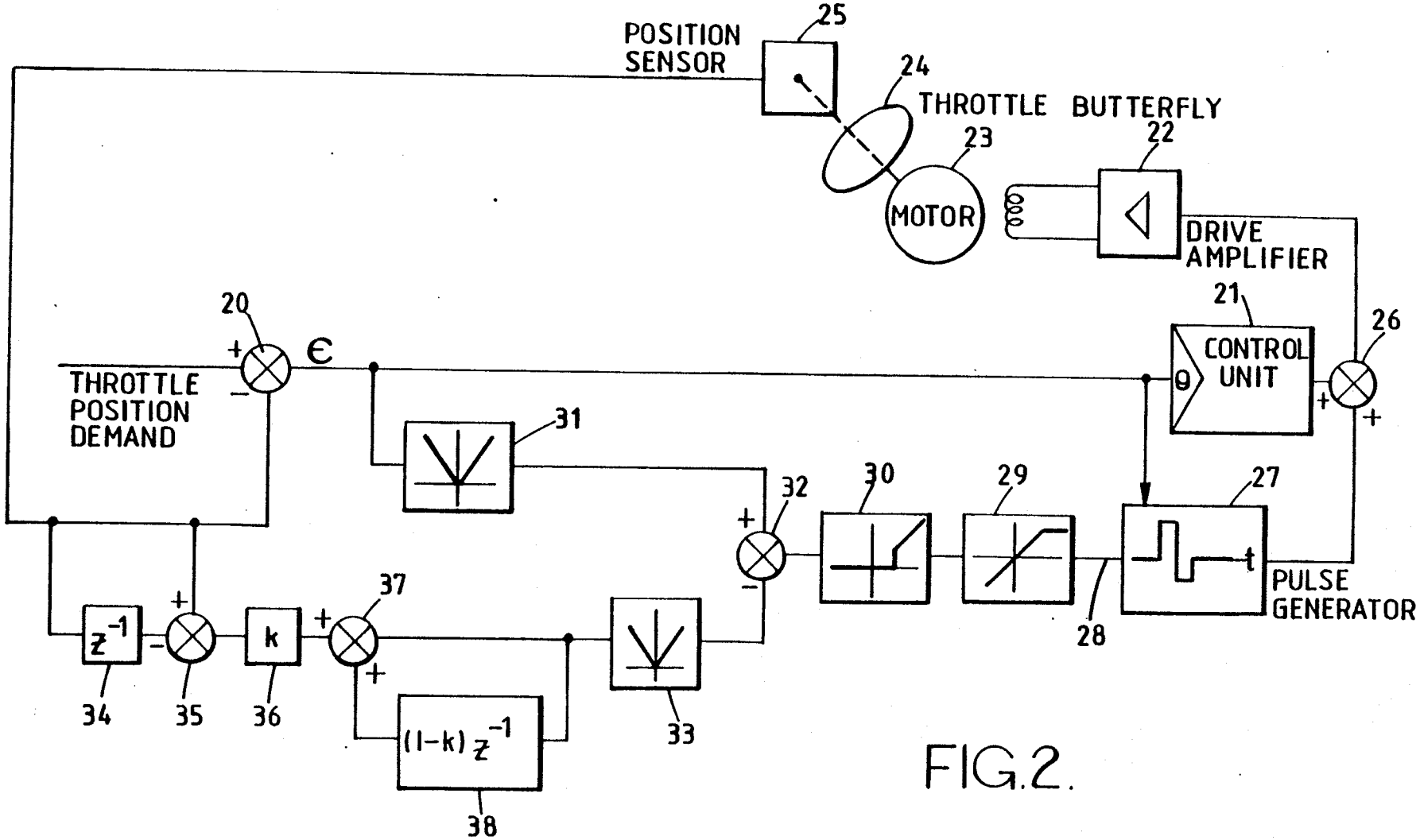

The invention will be further described, by way of example, with reference to the accompanying drawings, in which:

FIG. 1 is a block schematic diagram of an engine throttle control system constituting a first embodiment of the invention; and FIG. 2 is a block schematic diagram of an engine throttle control system constituting a second embodiment of the invention.

As shown in FIG. 1, a throttle butterfly 1 is directly driven by a motor 2 and is connected to a position sensor 3 which provides a throttle position signal $\theta$. A control unit 4 controls the motor 2 in response to a signal supplied to an input 5 and the throttle position signal $\theta$ which is supplied to an input 6.

A throttle position demand signal, for instance from an accelerator pedal position sensor or an engine management system, is supplied via an input 7 to a first input of a summer 8 whose output is connected to the input 5. The throttle position demand signal is also supplied to the input of a differentiating circuit whose output is connected to a second input of the summer 8.

The differentiating circuit comprises a delay circuit 9 whose input receives the throttle position demand signal and a subtracter 10 which subtracts the output of the delay circuit 9 from the throttle position demand signal. The output of the subtracter 10 is supplied via a deadband element 11 to a first input of a summer 12. The output of the summer 12 is connected to the input of a limiter 13 whose output forms the output of the differentiating circuit and is fed back through a delay and attenuating element 14 to a second input of the summer 12.

The differentiating circuit operates as follows. The delay element 9 and the subtracter 10 form a differentiating circuit with the dead-band element 11 making the differentiating circuit insensitive to relatively small signals, such as noise. The elements 12 to 14 convert the difference signals into smoothly decaying signals, with the constant of attenuation k being chosen to provide a suitable rate of decay for the purpose as described hereinafter. The limiter 13 has limit values chosen so as to ensure that larger changes in the throttle position demand signal do not give rise to excessive overshoot magnitude or demands outside the working range of the throttle.

When the throttle position demand signal changes, small changes in demand are exaggerated and become large enough so that the control unit 4 causes the motor 2 to move promptly. Thus, in the case of a direct drive throttle motor of relatively low inertia as seen at the throttle butterfly 1, the static friction forces are overcome by adding the differentiated throttle position demand signal to the throttle position demand signal and using this as the demand signal to the control unit 100. Once the throttle position demand signal stops changing, the differentiated signal soon falls to zero and the throttle position demand signal becomes the demand signal for the control unit 4. The throttle is therefore made to move relatively quickly without impairing the ability of the servo control loop to provide fine control for relatively small changes in throttle position. The positioning of the limiter 13 within the feedback loop prevents excessive persistence of overshoot signals for large inputs. Thus, the system maintains precise control while responding quickly to small changes in demand.

The system shown in FIG. 2 comprises a closed loop throttle servo system including a subtracter 20 for subtracting a throttle position signal $\theta$ from a throttle position demand signal, a control unit 21, a drive amplifier 22, a motor 23, a throttle butterfly 24 and a position sensor 25. In addition, a summer 26 is connected between the control unit 21 and the amplifier 22 so as to sum the output of the control unit 21 with the output of a pulse generator 27. The pulse generator 27 has a polarity control input connected to receive an error signal $\epsilon$ from the subtracter 21, and is arranged to produce first and second pulse signals, the first of which has the same polarity as the error signal e and the second of which has the opposite polarity and immediately follows the first. The amplitudes of the first and second pulses are determined by a signal supplied to an amplitude control input 28 of the generator, the amplitude of the second pulse being less than that of the first pulse, for instance there being a predetermined fixed ratio between the amplitudes.

The control input 28 is connected to the output of a limiter circuit 29 whose input is connected to the output of a circuit 30 which, for input signals above a threshold value, passes the input signals to the output and which, for input signals below the threshold value, sets the output to 0.

The input of the circuit 30 is connected to the output of a subtracter 32 whose positive input is connected to the output of a full wave rectifier 31 whose input receives the error signal $\epsilon$. The negative input of the subtracter 32 is connected to the output of a full wave rectifier 33 whose input is connected to the output of a differentiator. The differentiator comprises a delay element 34 for delaying the throttle position signal, a subtracter 35 for forming the difference between the delayed and undelayed throttle position signal, an attenuator 36 having a factor k of attenuation, a summer 37, and a delayed feedback circuit 38 for providing a predetermined rate of decay.

The amplitude of the pulses produced by the pulse generator 27 is thus 0 for relatively small errors and for relatively large rates of change of the throttle position, as provided by the operation of the circuit 30. However, where the size of the error signal exceeds the size of the rate of change of the throttle position by a predetermined amount, the amplitude of the pulses provided by the pulse generator is proportional to the difference between the error signal and the throttle speed until a limit threshold defined in the limiter 29 is reached.

Thus, whenever the throttle position demand signal changes by a sufficiently large amount and the throttle is not already moving at a sufficient speed, the pulse generator 27 superimposes an alternating torque or "dither" signal onto the output signal of the control unit 21. The polarity of the first pulse of the generator output signal is such as to help in overcoming the static friction and inertia of the motor 23 and accelerate the motor in a direction tending to reduce the error. The second pulse applies a reduced or reverse torque to the motor 23 so as to prevent the motor speed becoming too high and tending to cause overshoot in the action of the closed loop servo.

By superimposing the dither on the motor control system, the effects of static friction are at least partially overcome and the throttle response is improved.

We claim:

1. An engine throttle control system for a throttle motor, said system comprising a control circuit for supplying a drive to the throttle motor in response to an error between a throttle position demand signal and an actual throttle position signal, said control circuit including augmenting means responsive to a change in the throttle position demand signal for temporarily augmenting the throttle position demand signal by applying a transient increase to the change in the throttle position signal.

2. A system as claimed in claim 1, in which said augmenting means is arranged to supply the transient increase as a first pulse whose amplitude is a first function of a rate of change of the throttle position demand signal and whose polarity is a second function of a polarity of the rate of change of the throttle position demand signal.

3. A system as claimed in claim 2, in which said augmenting means comprises differentiating means for differentiating the throttle position demand signal to provide a differentiated signal and adding means for adding the differentiated signal to the throttle position demand signal.

4. A system as claimed in claim 1, in which said augmenting means is arranged to supply the transient increase as a second pulse whose amplitude is a third function of a rate of change of the actual throttle position signal and of a difference between the actual throttle position signal and the demanded throttle position signal, and whose polarity is a fourth function of a polarity of the difference between the actual throttle position signal and the demanded throttle position signal.

5. A system as claimed in claim 4, in which said augmenting means includes function generating means for forming a difference signal between an amplitude of the difference between the actual throttle position signal and the demanded throttle position signal and an amplitude of a rate of change of the actual throttle position signal.

6. A system as claimed in claim 4, in which said augmenting means is arranged to supply a third pulse subsequent to the second pulse and having a polarity which is opposite a polarity of the second pulse.

7. A system as claimed in claim 6, in which said augmenting means is arranged to supply the third pulse with an amplitude less than an amplitude of the second pulse.

8. A system as claimed in claim 1, in which said augmenting means includes limiting means for limiting an amplitude of the transient increase.

9. A system as claimed in claim 1, in which said augmenting means includes first inhibiting means for inhibiting the transient increase in response to a rate of change of the throttle position demand signal less than a predetermined rate.

10. A system as claimed in claim 5, in which said augmenting means includes second inhibiting means for inhibiting the transient increase when the difference signal is less than a predetermined value.

* * * * *